US006408941B1

(12) United States Patent
Zuo

(10) Patent No.: US 6,408,941 B1
(45) Date of Patent: Jun. 25, 2002

(54) FOLDED FIN PLATE HEAT-EXCHANGER

(75) Inventor: Jon Zuo, Lancaster, PA (US)

(73) Assignee: Thermal Corp., Stanton, DE (US)

( * ) Notice: Subject to any disclaimer, the term of this patent is extended or adjusted under 35 U.S.C. 154(b) by 0 days.

(21) Appl. No.: 09/898,774

(22) Filed: Jun. 29, 2001

(51) Int. Cl.[7] ..... F28D 21/00

(52) U.S. Cl. ..... 165/165; 165/DIG. 399; 165/164

(58) Field of Search ..... 165/164, 165

(56) References Cited

U.S. PATENT DOCUMENTS

| | | | | | |
|---|---|---|---|---|---|
| 1,601,637 | A | * | 9/1926 | Meigs | 165/165 |
| 2,019,351 | A | * | 10/1935 | Lathrop | 165/165 |
| 2,875,986 | A | | 3/1959 | Holm | 257/245 |
| 3,282,334 | A | | 11/1966 | Stahlheber | 165/166 |
| 3,380,517 | A | | 4/1968 | Butt | 165/166 |
| 3,734,177 | A | * | 5/1973 | Bellovary et al. | 165/166 |
| 3,829,945 | A | * | 8/1974 | Kanzler et al. | 165/166 |
| 3,934,618 | A | | 1/1976 | Henderson | 138/114 |
| 3,993,125 | A | | 11/1976 | Rhodes | 165/153 |
| 4,099,928 | A | * | 7/1978 | Norback | 165/166 |
| 4,428,418 | A | | 1/1984 | Beasley et al. | 165/76 |
| 4,615,383 | A | | 10/1986 | Hisao | 165/150 |
| 4,616,695 | A | * | 10/1986 | Takahashi et al. | 165/54 |
| 4,970,579 | A | | 11/1990 | Arldt et al. | 357/81 |
| 5,201,866 | A | | 4/1993 | Mok | 165/80.3 |
| 5,324,452 | A | | 6/1994 | Allam et al. | 252/373 |
| 5,335,414 | A | | 8/1994 | Joyce et al. | 29/726 |
| 5,494,100 | A | | 2/1996 | Peze | 165/157 |
| 5,584,341 | A | | 12/1996 | Sabin et al. | 165/166 |
| 5,660,049 | A | | 8/1997 | Erickson | 62/107 |
| 5,823,253 | A | | 10/1998 | Kontu | 165/167 |
| 6,059,023 | A | * | 5/2000 | Kurematsu | 165/165 |
| 6,098,706 | A | | 8/2000 | Urch | 165/166 |
| 6,119,766 | A | | 9/2000 | Blomgren | 165/81 |

FOREIGN PATENT DOCUMENTS

| | | | | |
|---|---|---|---|---|
| GB | 512689 B1 | * | 9/1939 | 165/165 |
| JP | 57-49793 A1 | * | 3/1982 | 165/165 |
| JP | 57-192791 A1 | * | 11/1982 | 165/165 |
| JP | 58-066793 | | 4/1983 | |
| JP | 58-182091 | | 10/1983 | |
| JP | 63-290394 | | 11/1988 | |
| JP | 9-105566 | | 4/1997 | |
| WO | WO 98/44554 | | 10/1998 | |

* cited by examiner

*Primary Examiner*—Allen Flanigan
(74) *Attorney, Agent, or Firm*—Duane Morris LLP

(57) ABSTRACT

A heat-exchanger is provided that comprises a fin core formed from a continuous sheet of thermally conductive material that has been folded into alternating flat ridges and troughs defining spaced fin walls having peripheral end edges wherein each of the fin walls has a thickness of about 0.020 inches of its length. The heat-exchanger may include at least one air-barrier plate fastened to the flat ridges on a first side of the fin core and a liquid-barrier plate fastened to the flat ridges on a second side of the fin core. A pair of end caps are sealingly fastened to and cover the peripheral end edges of the fin core so as to form a plurality of input and exit openings that communicate with the troughs. The fin wall thickness of about 0.002 inches to about 0.020 inches of its length is such that polymer materials may be selected from the group consisting of polyhalo-olefins, polyamides, polyolefins, poly-styrenes, polyvinyls, poly-acrylates, polymethacrylates, polypropylene, polyesters, polystyrenes, polydienes, polyoxides, polyamides and polysulfides, for use in forming the fin core.

8 Claims, 4 Drawing Sheets

FOLDED FIN PLATE HEAT-EXCHANGER

FIELD OF THE INVENTION

The present invention generally relates to heat-exchangers, and more particularly to heat-exchangers of the type including plates arranged side-by-side and mutually parallel.

BACKGROUND OF THE INVENTION

Heat-exchangers including a plurality of mutually parallel plates, with channels that are adapted to carry at least one heat transfer fluid, are well known in the art. Such parallel plate devices are often formed from a continuous sheet of metal, as a "folded-fin". The plates in such prior art heat-exchangers often consist of metal sheets which delimit a multiple circuit for circulation of two independent fluids, in counterflow, from one end of the exchanger to the other. The plates are often connected to one another at their longitudinal edges by longitudinal braces or the like that are fixed together by a leak-tight wall extending over the entire length and height of the bundle of plates. The plates define a central zone for heat exchange between the fluids.

In some prior art structures, the plates may have one or more corrugated sheets positioned between them, in the central heat transfer and exchange zone, to enhance heat exchange with the plates by increasing surface area and introducing turbulence in the flowing liquids. For example, U.S. Pat. No. 5,584,341, discloses a plate bundle for a heat-exchanger, including a stack of mutually parallel metal heat-exchange plates. Each heat-exchange plate includes smooth-surfaced edges and a corrugated central part, which with the associated heat-exchange plates, forms a double circuit for circulation of two independent fluids in counter-flow. The plates are connected to one another at their longitudinal edges by connection means, and comprise a zone of heat transfer and exchange between the fluids. Another zone is formed at the free ends of the plates for inlet and outlet of the fluids. The fluid inlet and outlet zones are formed by the plane ends of the heat-exchange plates.

A significant disadvantage in prior art heat-exchangers of the type described herein above is the inherent thermal impedance, i.e., resistance to thermal conduction through the thickness of the plate, associated with the materials used to form the heat-exchange plates. These prior art heat-exchange plates must have sufficient thickness so as to provide the requisite structural integrity needed for the physical demands that are placed on such devices in normal use. Very often, the heat exchange plates are required to structurally support a portion of the heat exchanger. These design requirements typically require a minimum material thickness (e.g., a material thickness that is some minimum percentage of the plates width or length) that results in a disadvantageous inherent thermal impedance. Material selection is also dictated by this requirement, normally resulting in only metals being selected for the heat-exchange plates. Polymer materials typically exhibit significant dielectric and thermal insulating properties that preclude their use in heat-exchange plates, especially when they are required to provide structural integrity to the device.

There is a need for a heat-exchanger plate structure which will provide the requisite structural integrity needed to survive the physical demands that are placed on such devices in normal use, and which would allow for the use of very thin materials, and even nonmetals, in its fabrication.

SUMMARY OF THE INVENTION

The present invention provides a heat-exchanger comprising a fin core formed from a continuous sheet of thermally conductive material that has been folded into alternating flat ridges and troughs defining spaced fin walls having peripheral end edges wherein each of the fin walls has a thickness of about 0.002 to 0.020 inches. In one preferred embodiment the heat-exchanger of the present invention includes at least one air-barrier plate fastened to the flat ridges on a first side of the fin core and a liquid-barrier plate fastened to the flat ridges on a second side of the fin core. A pair of end caps is sealingly fastened to, and covers, the peripheral end edges of the fin core so as to form a plurality of input and exit openings that communicate with the troughs. Advantageously, the fin wall thickness of about 0.002 to 0.020 inches is such that polymer materials may be selected from the group consisting of polyhalo-olefins, polyamides, polyolefins, poly-styrenes, polyvinyls, poly-acrylates, polymethacrylates, polypropylene, polyesters, polystyrenes, polydienes, polyoxides, polyamides and polysulfides, for use in forming the fin core.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
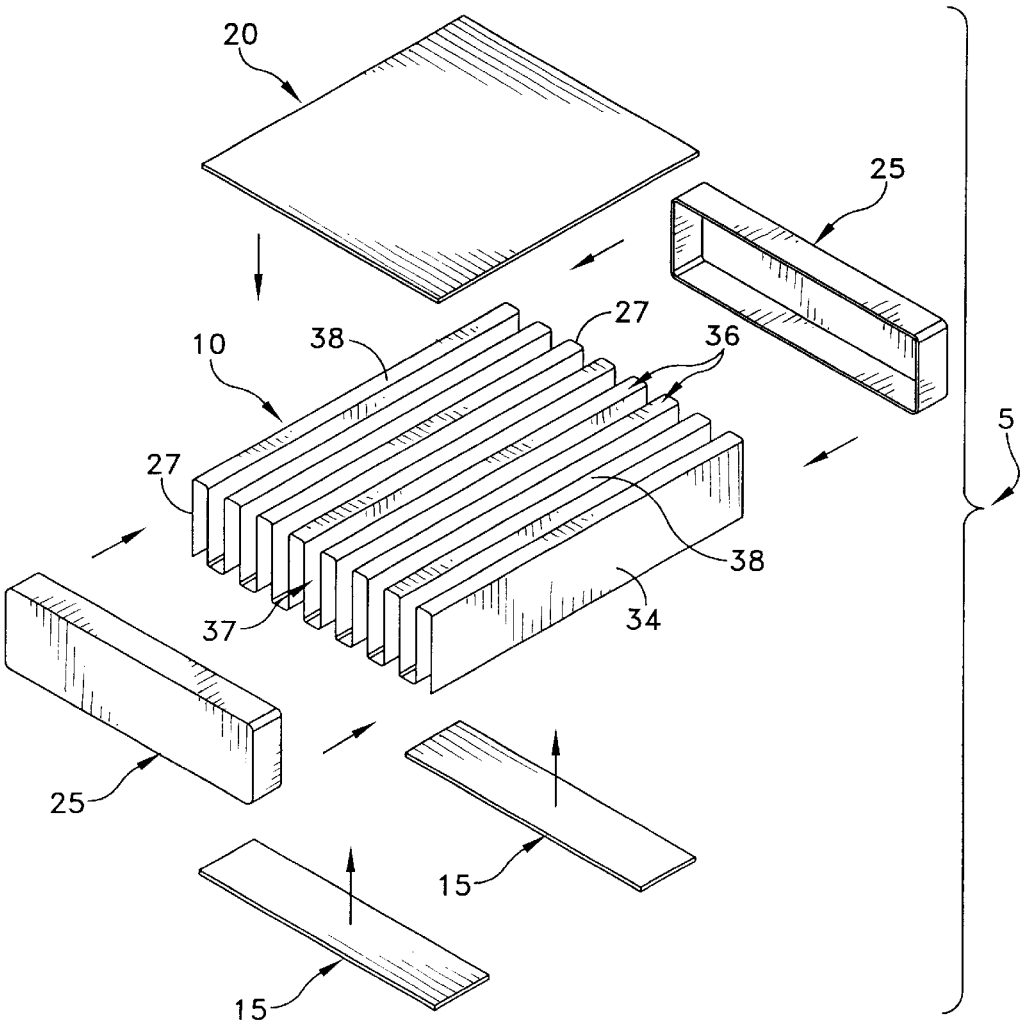
FIG. 1 is an exploded perspective view of a folded fin heat-exchanger according to the present invention.
Figure 2:
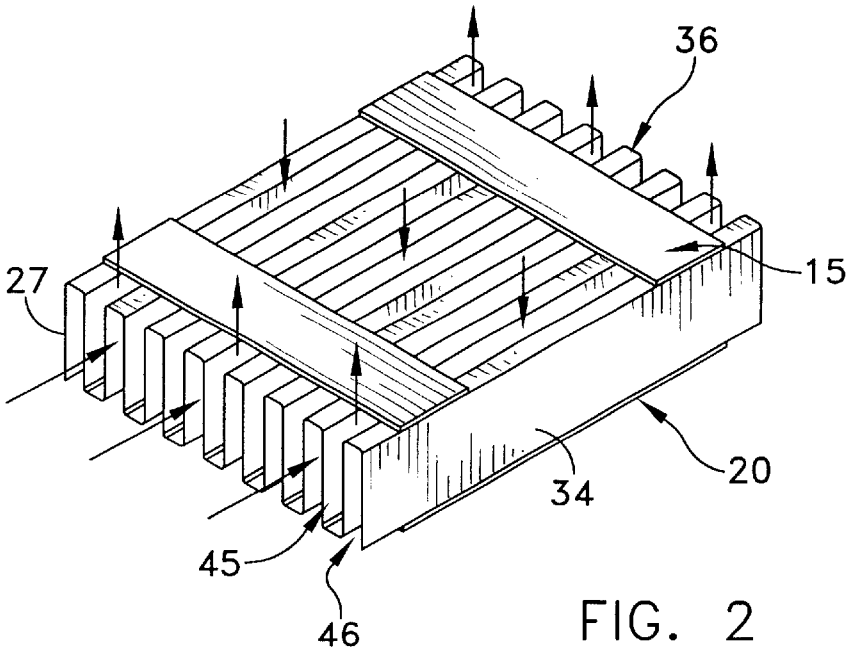
FIG. 2 is a perspective view of the folded fin heat-exchanger shown in FIG. 1, with fluid flow directions indicated by arrows in the figure.

This description of preferred embodiments is intended to be read in connection with the accompanying drawings, which are to be considered part of the written description of this invention. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring to FIGS. 1–4, a folded fin heat-exchanger 5 formed according to the present invention comprises a fin core 10, at least one air-barrier plate 15, a liquid-barrier plate 20, and end caps 25. More particularly, fin core 10 is formed by folding a continuous sheet of thermally conductive material, such as a metal or a polymer, back-and-forth upon itself so as to create a pleated or corrugated cross-sectional profile. Fin core 10 may be formed from any one of the metals known for having superior heat transfer and structural properties, such as stainless steel, aluminum and its alloys, copper and its alloys, as well as other thermally conductive metals and combinations of metals. Alternatively, fin core 10 may be formed from a polymer, such as one or more of the well known engineering polymers, e.g., polyhalo-olefins, polyamides, polyolefins, poly-styrenes, polyvinyls, poly-acrylates, polymethacrylates, polypropylene, polyesters, polystyrenes, polydienes, polyoxides, polyamides and polysulfides and their blends, co-polymers and substituted derivatives thereof.

Fin core 10 includes peripheral side edges 27 and a plurality of substantially parallel, thin fin walls 34 separated from one another by alternating flat ridges 36 and troughs 37 (FIG. 1). Each pair of thin fin walls 34 are spaced apart by a flat ridge 36 so as to form each trough 37 between them. Thus fin core 10 comprises a continuous sheet of thermally conductive material folded into alternating flat ridges 36 and troughs 37 defining spaced thin fin walls 34 having peripheral end edges 27. Each flat ridge 36 provides a flat top surface 38 that is less prone to damage, and is more suitable for brazing, soldering, or welding, or in the case of a polymer, chemically or thermally attaching flat ridge 36 to barrier plates 15,20. Although flat ridges 36 are not pointed or sharp, in one less preferred embodiment, fin walls 34 may also have a divergent shape, rather than being substantially parallel to one another. Advantageously, fin walls 34 have a thickness that is no more than about 0.020", and in a preferred embodiment have a thickness in the range from about 0.002 to 0.020 inches. In this way, the thermal impedance of fin walls 34 to the conduction of thermal energy is in a range of no more than about $2.5\times10^{-3\circ}$ C./w/cm$^2$ to about $2.54\times10^{-2\circ}$ C./w/cm$^2$ for aluminum material. Although influenced by the particular material selected to form fin core 10, these relationships and ranges will be when practicing the present invention.

Figure 5:
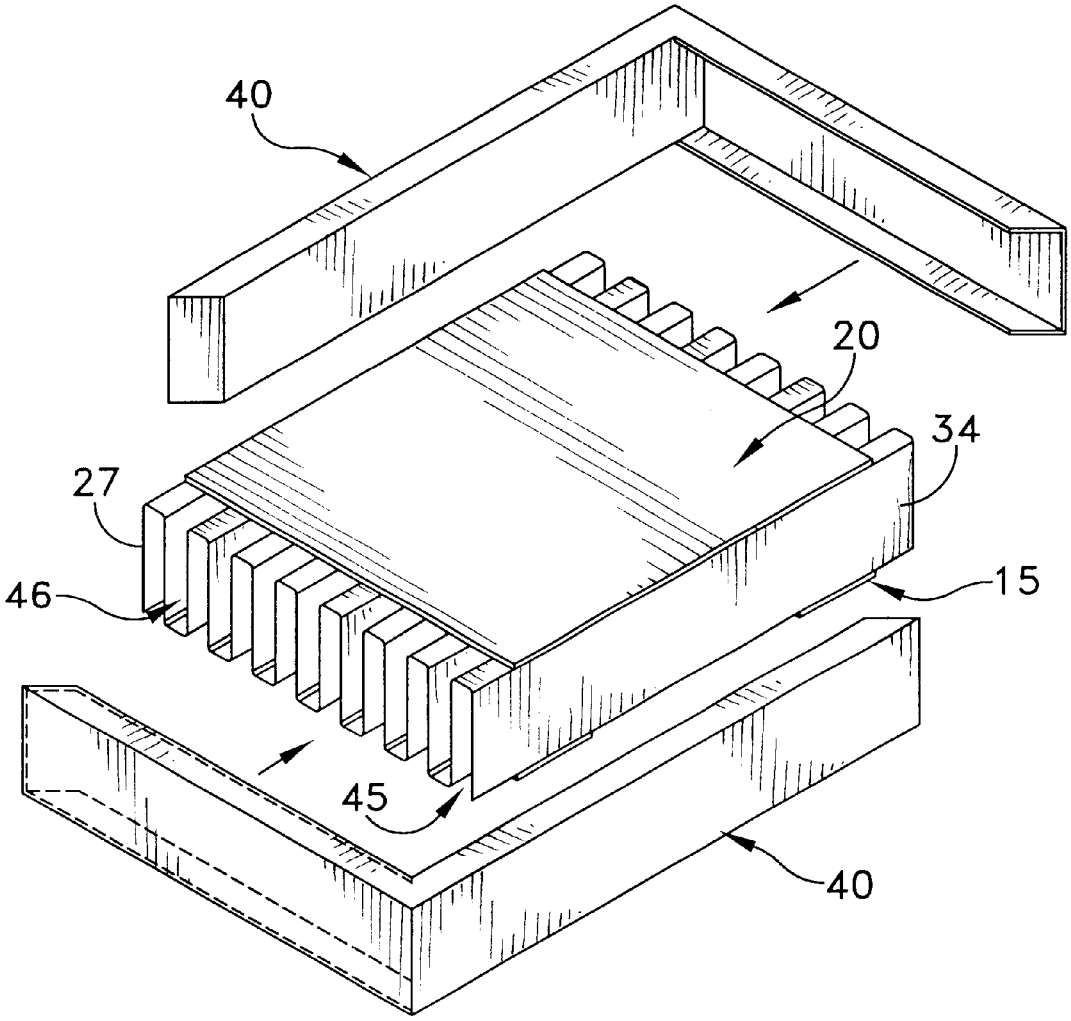
FIG. 5 is a cross-sectional view of an operating folded fin heat-exchanger formed according to the invention.

Air-barrier plates 15 and liquid-barrier plate 20 comprise substantially flat sheets of metal or polymer, depending upon the material selected for fin core 10. Each air-barrier plate 15 is arranged in overlying relation to a plurality of flat ridges 36 on one side of fin core 10 and each liquid-barrier plate 20 is arranged in overlying relation to a plurality of flat ridges 36 on the other side of fin core 10. Barrier plates 15,20 are brazed, soldered, or welded (or chemically or thermally adhered in the case of a polymer) to a plurality of flat ridges 36. As a result of this construction, portions of troughs 37 that are adjacent to air-barrier plates 15 are partially enclosed so as to form conduits 45, and portions of troughs 37 that are adjacent to liquid-barrier plate 20 are substantially enclosed so as to form conduits 46, on respective sides of fin core 10. End caps 25 are sized and shaped to extend over and surround peripheral side edges 27 of fin core 10 so as to close-off the open ends of troughs 37, and thereby form entrance and exit openings to and from conduits 45,46 between the edge of barrier plates 15, 20 and end caps 25. In one embodiment, end caps 25 comprise an open ended rectangular box shape (FIG. 3), and in another embodiment end caps 40 comprises an "L" -shape profile (FIG. 5).

Figure 3:
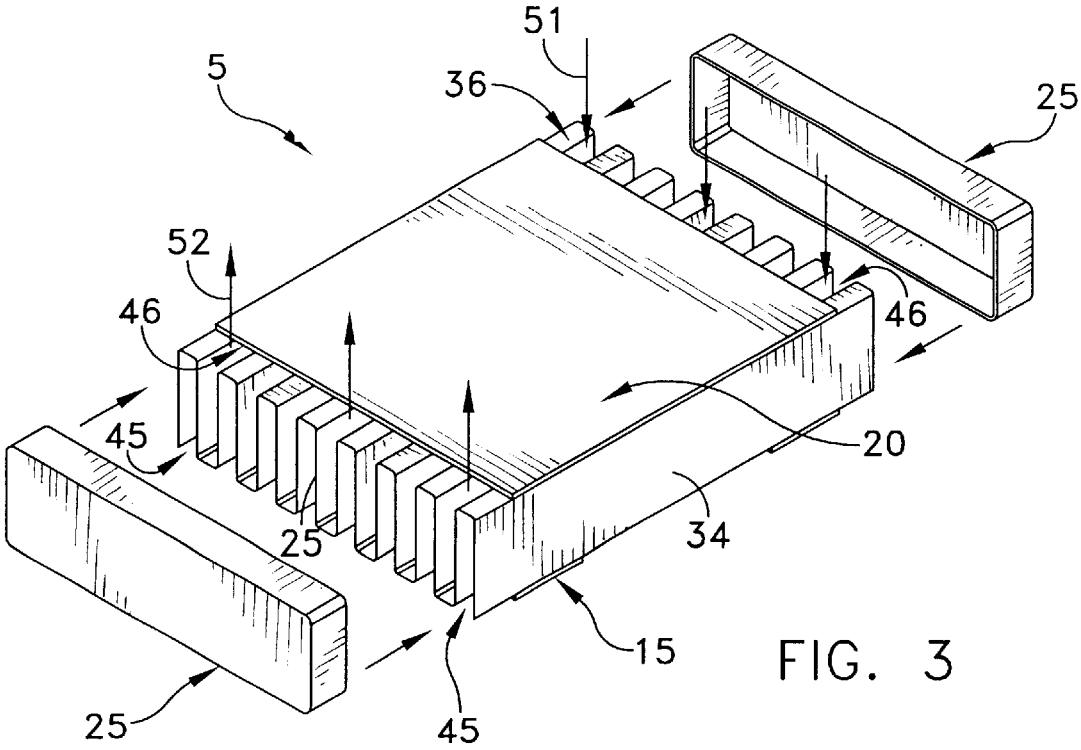
FIG. 3 is an exploded perspective view of the folded fin heat-exchanger shown in FIG. 1, end caps shown just prior to assembly to the peripheral side edges of the fin core.
Figure 4:
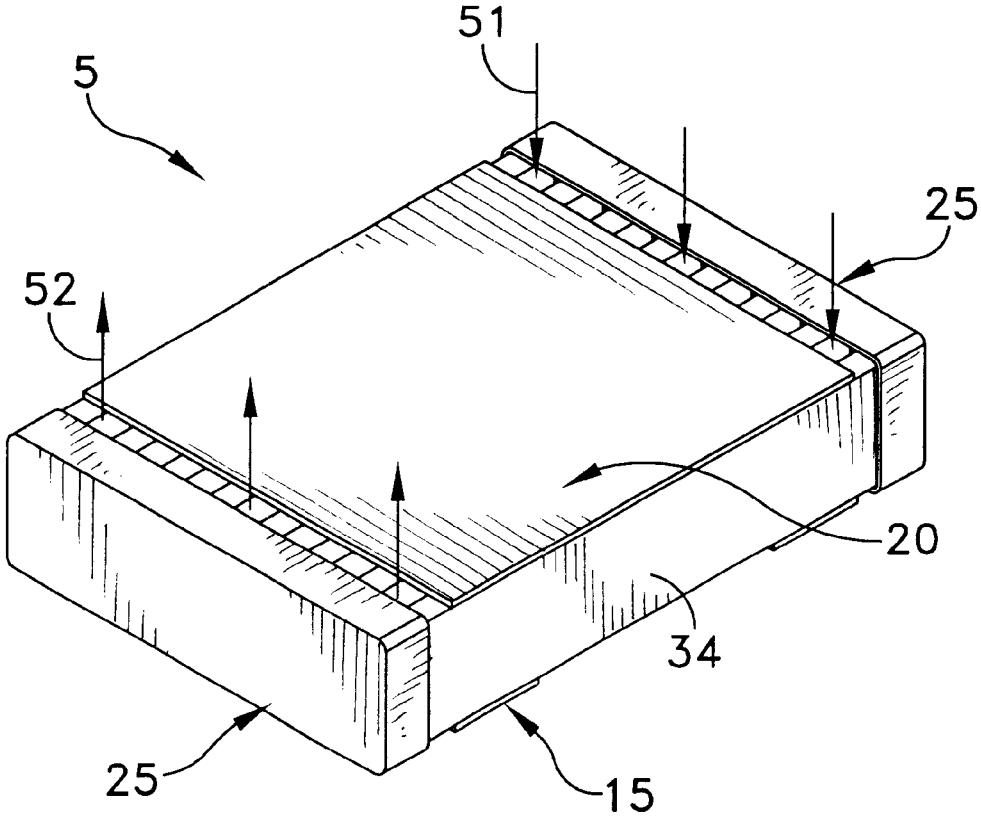
FIG. 4 is an exploded perspective bottom view of the folded fin heat-exchanger shown in FIG. 1, with alternative end caps shown just prior to assembly to the fin core.

Referring to FIGS. 1 and 3, folded fin heat exchanger 5 is assembled in the following manner. Fin core 10 is arranged with liquid-barrier plate 20 positioned in confronting parallel relation to a first set of flat ridges 36 on one side of fin core 10, and a pair of air-barrier plates 15, are positioned in confronting parallel relation to a second set of flat ridges 36, and liquid-barrier plate 20. In this way, fin core 10 is sandwiched between liquid-barrier plates 20 and air-barrier plates 15. Once in this position, barrier plates 15, 20, are moved into an engagement with flat tops surfaces 38 of flat ridges 36, and are brazed, or soldered into place in the case of metals, and chemically or thermally bonded in place in the case of polymers. In this way, a plurality of conduits 45, 46, are formed within fin core 10, which are bounded by fin walls 34, flat ridges 36, and either air-barrier plates 15 or liquid-barrier plates 20. End caps 25 (or L-shaped end caps 40) are then positioned in parallel confronting relation with peripheral side edges 27 of fin core 10 (FIGS. 3 and 5). Once in this position, end caps 25 (or L-shaped end caps 40) are moved toward peripheral side edges 27 until an end portion of fin core 10 slips into an inner recess in end cap 25. In this construction, an entrance port 51 and an exit port 52, are formed between an edge of end cap 25 (or L-shaped end cap 40) and an edge of liquid-barrier plate 20 (FIG. 4).

Advantages of the Invention

It is to be understood that the present invention is by no means limited only to the particular constructions herein disclosed and shown in the drawings, but also comprises any modifications or equivalents within the scope of the claims.

Numerous advantages are obtained by implying the present invention. More specifically, a folded fin heat exchanger is provided which avoids many of the aforementioned problems associated with prior art heat exchange devices.

In addition, a folded fin heat exchange core is provided in which double impingement is utilized to increase the convective heat transfer coefficient by at least a factor of two, compared to counter-flow heat convection. The thin fin core presents negligible thermal resistance, compared to a heat pipe core. Thus, the present invention offers improved thermal performance when compared to the same size unit of standard design or reduced heat exchanger size when compared to a standard size unit with the same thermal performance.

Furthermore, a folded fin heat exchanger is provided having a lower manufacturing cost, but with increased thermal performance by using a more efficient, double side impingement flow configuration instead of higher cost blowers or larger size cores.

Also, an improved folded fin heat exchanger is provided with higher reliability than other heat exchangers.

Furthermore, an improved folded fin heat exchanger is provided which allows for significantly more flexibility in the selection of fin materials. The heat conduction path is across the fin thickness instead of along the fin length/width as in other types of prior art heat exchangers. Therefore, the thermal conductivity of the fin material does not need to be very high, as long as the fin thickness is small, relative to its length or width. For example, replacing a 0.01 inch thick aluminum fin core with a polymerfin core results in a less than two percent performance reduction. This opens the possibility of making all plastic heat exchangers that are light and inexpensive.

Also, an improved folded fin heat exchanger is provided which is more tolerant on mechanical/thermal joints than other types of heat exchangers which must transfer heat across certain joints. This requires that the joints to be assembled with materials of high thermal conductivity. The present invention does not have such joints on the heat flow paths and thus can be assembled using materials that do not have high thermal conductivity, i.e., one of the well known engineering polymers disclosed here and above.

What is claimed is:

1. A heat-exchanger comprising a fin core comprising a continuous sheet of thermally conductive material folded into alternating flat ridges and troughs defining spaced fin walls having peripheral end edges, wherein each of said fin walls has a thickness of about 0.002 to 0.020 inches, and wherein at least one air-barrier plate is sealingly fastened to said flat ridges on a first side of said fin core, a liquid-barrier plate is sealingly fastened to said flat ridges on a second side of said fin core, and an open ended rectangular box shaped end cap is mounted over said peripheral end edges of said spaced fin walls so that air flows through selected ones of said troughs and liquid flows through selected other ones of said troughs.

2. A heat-exchanger according to claim 1 wherein said spaced fin walls are substantially parallel.

3. A heat-exchanger according to claim 1 wherein said spaced fin walls have a thickness in the range from about 0.002 inches to about 0.020 inches.

4. A heat-exchanger according to claim 1 wherein said spaced fin walls comprises a thermal impedance to the conduction of thermal energy in the range of about $2.5\times10^{-3}$° C./w/cm$^2$ to about $2.54\times10^{-2}$°C./w/cm$^2$ for aluminum.

5. A heat-exchanger according to claim 1 wherein said open ended rectangular box shaped end cap extends over and surrounds said peripheral side edges of said fin core so as to close-off the open ends of said troughs and thereby form flow entrance and flow exit openings adjacent to said at least one air-barrier plate and said liquid-barrier plate so that said air flows through selected ones of said troughs and liquid flows through selected other ones of said troughs.

6. A heat-exchanger comprising:

a fin core comprising a continuous sheet of thermally conductive material folded into alternating flat ridges and troughs defining spaced fin walls having peripheral end edges wherein each of said fin walls has a thickness of about 0.002 inches to 0.020 inches;

at least one air-barrier plate is sealingly fastened to said flat ridges on a first side of said fin core and a liquid-barrier plate is sealingly fastened to said flat ridges on a second side of said fin core; and open ended rectangular box shaped end caps, sealingly covering said peripheral end edges of said fin core so as to form a plurality of input and exit openings that communicate with said troughs so that air flows through selected ones of said troughs and liquid flows through selected other ones of said troughs.

7. A heat-exchanger comprising:

a fin core comprising a continuous sheet of thermally conductive material selected from the group consisting of polyhalo-olefins, polyamides, polyolefins, polystyrenes, polyvinyls, poly-acrylates, polymethacrylates, polypropylene, polyesters, polystyrenes, polydiones, polyoxides, polyamides and polysulfides, and forming alternating flat ridges and troughs defining spaced fin walls having peripheral end edges wherein each of said fin walls has a thickness of about 0.002 inches to 0.020 inches;

at least one air-barrier plate fastened to said flat ridges on a first side of said fin core and a liquid-barrier plate fastened to said flat ridges on a second side of said fin core; and open ended rectangular box shaped end caps sealingly covering said peripheral end edges of said fin core so as to form a plurality of input and exit openings that communicate with said troughs so as to provide for impingement of at least one of air and liquid onto portions of said fin core so that air flows through selected ones of said troughs and liquid flows through selected other ones of said troughs.

8. A heat-exchanger comprising a fin core comprising a continuous sheet of thermally conductive material folded into alternating flat ridges and troughs defining spaced fin walls having peripheral end edges, wherein each of said fin walls has a thickness of about 0.002 to 0.020 inches, and wherein at least one air-barrier plate is sealingly fastened to said flat ridges on a first side of said fin core, a liquid-barrier plate is sealingly fastened to said flat ridges on a second side of said fin core, and two and caps each including a first arm having an open ended rectangular box shape and a second arm projecting perpendicularly outwardly from an end of said first arm and extending along and mounted over said peripheral end edges of said spaced fin walls so that air flows through selected ones of said troughs and liquid flows through selected other ones of said troughs.

* * * * *